US006165031A

United States Patent [19]

Lönngren et al.

[11] Patent Number: 6,165,031

[45] Date of Patent: Dec. 26, 2000

[54] MARINE PROPULSION AND STEERING UNIT

[75] Inventors: Stig Lönngren; Jan Pettersson, both of Kristinehamn, Sweden

[73] Assignee: Kamewa AB, Kristinehamn, Sweden

[21] Appl. No.: 09/194,911

[22] PCT Filed: Jun. 6, 1997

[86] PCT No.: PCT/SE97/00997

§ 371 Date: Dec. 4, 1998

§ 102(e) Date: Dec. 4, 1998

[87] PCT Pub. No.: WO97/46445

PCT Pub. Date: Dec. 11, 1997

[30] Foreign Application Priority Data

Jun. 6, 1996 [SE] Sweden ..... 9602235

[51] Int. Cl.[7] ..... B63H 25/42

[52] U.S. Cl. ..... 440/51; 440/53

[58] Field of Search ..... 440/67, 51, 53, 440/54, 71

[56] References Cited

FOREIGN PATENT DOCUMENTS 0 269 272 6/1988 European Pat. Off. .

0 590 867 4/1994 European Pat. Off. .

*Primary Examiner*—S. Joseph Morano
*Assistant Examiner*—Ajary Vasudeva
*Attorney, Agent, or Firm*—Browdy and Neimark

[57] ABSTRACT

A marine propulsion and steering unit (10) comprises a pod (13) having front and rear ends, a driving machine (14), e.g. a drive motor, accommodated in the pod, a substantially horizontal propeller shaft (15) drivingly connected to the driving machine and provided with a propeller (18) externally of the front end of the pod (13), and an upright pod supporting strut (12) rigidly attached to the pod and having at the upper end thereof swivel bearing means (11) supporting the pod supporting strut and the pod below a buoyant body for angular motion about a substantially vertical axis (C). The pod supporting strut (12) is shaped essentially as an upstanding airfoil the chord plane (V) of which contains or is proximal to the axis (T) of the propeller shaft (15) and the leading edge (12A) of which is directed towards the propeller (18). At the trailing edge (12L) thereof the pod supporting strut (12) is provided with a rudder (19) which is angularly movable about an axis (L) disposed in or parallel to the chord plane (V) of the pod supporting strut and at an angle to the axis (T) of the propeller shaft.

4 Claims, 1 Drawing Sheet

MARINE PROPULSION AND STEERING UNIT

BACKGROUND OF THE INVENTION

1. Technical Field of the Invention

This invention relates to a marine propulsion and steering unit.

2. Prior Art

More particularly, the invention relates to a marine propulsion and steering unit of the kind comprising a pod having front and rear ends, a driving machine accommodated in the pod, a substantially horizontal propeller shaft drivingly connected to the driving machine and provided with a propeller externally of the front end of the pod, and an upright pod supporting strut rigidly attached to the pod and having at the upper end thereof swivel bearing means supporting the pod supporting strut and the pod below a buoyant body for angular motion about a substantially vertical axis.

The buoyant body may be a ship, a work platform, a pontoon, or a similar floating body.

A propulsion and steering unit of this kind is known from EP-B-0 394 320. Because the unit is angularly movable about a vertical axis, it may be used not only for the propulsion, but also for the steering of the ship or other buoyant body equipped with the unit, and at the same time the rudder can also be used for the steering. Angular adjustment of the entire unit may also be combined with deflection of the rudder.

If the buoyant body equipped with the unit is a ship adapted to be run at a high speed, 20 knots or more, for example, the unit will be subjected to very great forces by the water if it is turned while the ship is running at such high speed. The swivel bearing and the actuators and other components used for the turning of the unit will therefore be heavily stressed during steering manoeuvres. When the ship is running at a high speed, steering by means of the rudder is therefore preferred. Steering by turning the entire unit, possibly combined with deflection of the rudder, is resorted to when running at a lower speed, such as when the ship is manoeuvred in harbours or narrow waterways.

In the known unit, the pivotal axis of the rudder coincides with the vertical turning axis of the unit. In certain operating conditions, this arrangement of the turning axes causes hydrodynamical problems which are related to the position of the rudder and the inhomogeneous flow of the water impinging on the unit when the unit is angularly offset from the fore and aft vertical centre-line plane of the ship.

OBJECT AND SUMMARY OF THE INVENTION

It is an object of the invention to provide a propulsion and steering unit which is improved in respect of these problems.

This object is achieved according to the invention by shaping the pod supporting strut essentially as an upstanding airfoil the main or chord plane of which contains or is proximal to the axis of the propeller shaft and the leading edge of which is directed towards the propeller, and by providing the pod supporting strut at the trailing edge thereof with a rudder which is angularly movable about an axis disposed in or parallel to the chord plane of the pod supporting strut and at an angle to the axis of the propeller shaft.

Designing the unit in accordance with the invention results in a significant reduction of the above-mentioned problems without detracting from the possibility of steering the ship at high speeds using only the rudder, that is, with the unit remaining in its normal position, the cruising position, in which the propeller shaft is aligned with the fore and aft vertical centre-line plane of the ship, and also without detracting from the possibility of steering the ship by angularly moving the unit a suitable angle when running at low speeds, e.g. when manoeuvring the ship in harbours or narrow waterways.

Because the pod supporting strut is shaped as an airfoil (or hydrofoil) and its horizontal cross-section accordingly resembles an airfoil profile or the contour of a falling drop of water, at least over the major portion of the height of the strut, and because the rudder is mounted at the trailing edge of the strut, preferably flush-mounted in the strut such that the rudder when in the neutral position forms a smooth extension of the portion of the strut which is in front of it, the rudder can function very effectively at the high speeds for which it is primarily intended. An effective surface area of the rudder which is only a fraction of the surface area required for a normal main rudder of a corresponding ship is therefore adequate. The positioning of the rudder a substantial distance from the propeller and from the turning axis is advantageous in respect of the cavitation problem, particularly so in combination with the streamlined cross-section of the pod supporting strut.

Actuation of the rudder may take place using a rudder actuator positioned at the upper end of the pod supporting strut and connected to the rudder. Alternatively, the rudder can be actuated by means of an actuator disposed in the pod.

The invention will be described in greater detail below with reference to an embodiment shown in the accompanying drawing.

DETAILED DESCRIPTION OF THE PREFERRED EMBODIMENT(S) OF THE INVENTION

Figure 1:
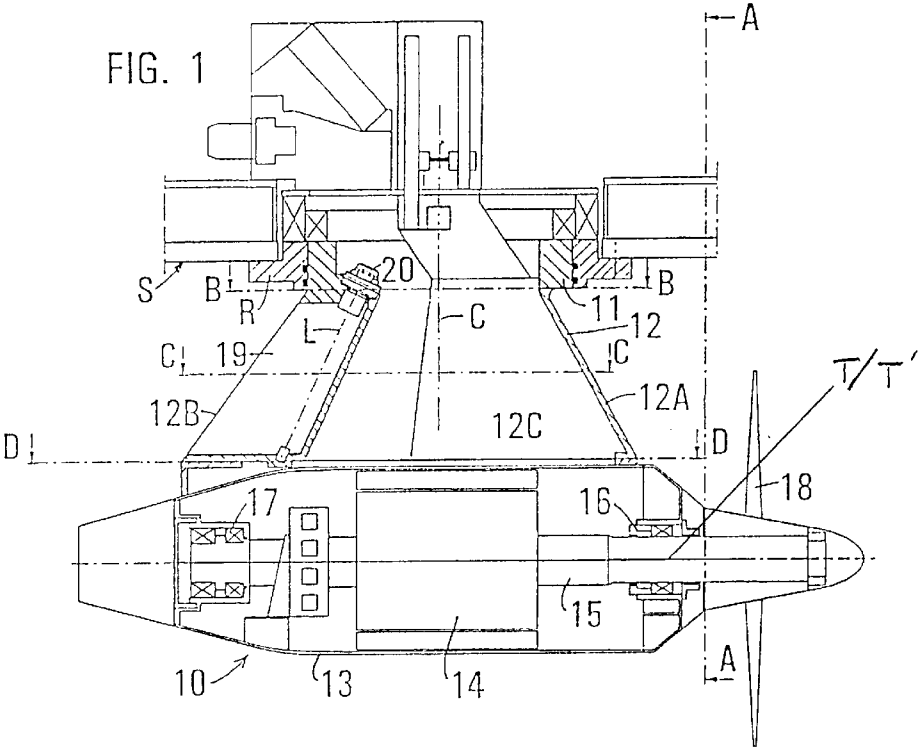
FIG. 1 is a vertical longitudinal sectional view of a propulsion and steering unit embodying the invention, the unit being mounted in a ship's hull which is only partly shown.

Referring to the figures, the propulsion and steering unit 10 shown therein is suspended from the bottom S of a ship's hull which is not shown except for a small portion of the bottom. A bearing ring R secured to the hull bottom S forms a rotational or swivel bearing in which a support ring 11 of the unit 10 is turnable about a vertical axis C. The detailed construction of the swivel bearing formed by the bearing ring R and the support ring 11 forms no part of the invention and will not be described. Disposed above the bearing ring R and the support ring 11 is machinery for turning the support ring, supplying power to the unit and cooling of the unit. The detailed construction of such equipment, which includes, for example, hydraulic motors or cylinders, likewise forms no part of the invention.

Secured to the support ring 11 is the upper end of a vertical support or hanger, hereinafter referred to as the strut and designated by 12, the lower end of which is rigidly but removably attached to an elongate, generally cylindrical or bulbous, horizontally oriented housing, hereinafter referred to as the pod and designated by 13, which accommodates a driving machine. In the illustrated embodiment, the driving machine accommodated by the pod 13 is a drive motor 14, namely an electric motor. The output shaft 15 the motor 14 is horizontal and concentric with the axis of the pod 13. It is supported in bearings 16 and 17 disposed within the pod externally of the stator of the motor. One end of the shaft projects through one end of the pod, the right-hand end in FIG. 1. The projecting shaft end carries a propeller 18 designed to operate as a pulling propeller. Thus, when viewed in the normal direction of propulsion, the right-hand end of the pod 13 is the front end.

Figure 2:
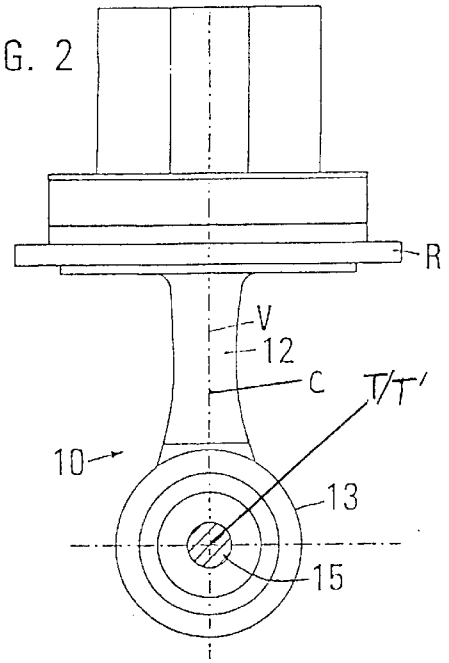
FIG. 2 shows the unit as viewed from line A—A of FIG. 1.
Figure 3:
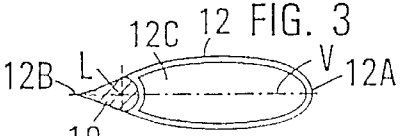
FIGS. 3–5 are horizontal sectional views at different levels, indicated by lines B—B, C—C and D—D of FIG. 1, of the strut by which the pod accommodating the driving machine is suspended from the hull bottom.

As is apparent from the cross-sectional views in FIGS. 1–3, the cross-sectional shape of the pod supporting strut 12 resembles an airfoil profile at least over the main portion of the height of the pod supporting strut 12. Accordingly, the cross-section of the pod supporting strut 12 is rounded at the leading edge 12A, then increases in width rearwardly up to a maximum less than halfway towards the trailing edge 12B, and gradually narrows down to a very small width at the trailing edge. The length of the cross-section, i.e. of the airfoil profile chord, gradually increases from the support ring 11 towards the motor pod 13. Both the leading edge 12A and the trailing edge 12B include an acute angle with the turning axis C and they converge towards a point above the hull bottom S.

Figure 4:
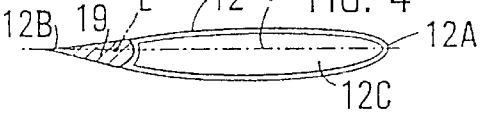
Figure 5:
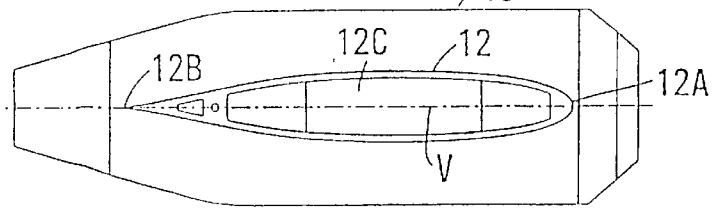

As is also apparent from FIGS. 3–5, in the illustrated embodiment the airfoil profile is doubly convex throughout the height of the pod supporting strut 12 and asymmetric at least in the mid-portion of the strut. The asymmetry is chosen in dependence of the direction of rotation of the propeller 18. Moreover, it is seen from FIGS. 2 and 5 that the longitudinal pod axis T' and the axis T of the motor/propeller shaft 15 coinciding with it are contained in the vertical main plane V, the chord plane of the airfoil profile, of the pod supporting strut 12. Different asymmetric airfoil profiles, and also symmetric airfoil profiles can be used.

The pod supporting strut 12 is hollow, and the cavity 12C it defines forms channels for passing cooling air to and from the drive motor 14 and for accommodating conduits for lubricating oil etc.

Throughout the main portion of the height of the pod supporting strut 12, the trailing edge portion of the strut is formed by a rudder flap 19, which is shaped and flush-mounted in a recess in the strut such that when the rudder flap is in its neutral, non-deflected position as shown, its cross-sectional profile forms a smooth continuation of the portion of the strut which is in front of it.

The rudder flap 19 is pivotally movable about an axis L, which is substantially parallel to or includes only a small angle with the trailing edge 12B, by means of a rudder actuator 20, such as a hydraulic motor, mounted in the support ring 11 at the upper end of the pod supporting strut 12. The rudder actuator may also be positioned at different places, such as above the support ring 11 or inside the pod 13.

Naturally, the invention is not limited to the embodiment shown by way of example and accordingly may be modified in different ways within the scope of the inventive concept and the claims. For example, where the driving machine is a motor it may be a hydraulic motor. It should be noted, however, that the driving machine need not be a motor; it may also be an angle gear or other transmission transmitting driving power from a drive motor or engine in the ship's hull to the propeller shaft.

Moreover, the turning axis C and the propeller shaft axis T may be slightly inclined in the main plane V to include a small angle with the vertical or the horizontal directions. Normally, the inclination would not be greater than about 5° but inclinations up to about 15° are possible.

What is claimed is:

1. A marine propulsion and steering unit, comprising a pod (13) having front and rear ends, a driving machine (14) accommodated in the pod, a substantially horizontal propeller shaft (15) drivingly connected to the driving machine and provided with a propeller (18) externally of the front end of the pod (13), and an upright pod supporting strut (12) rigidly attached to the pod and having at an upper end thereof a swivel bearing (11), the swivel bearing adapted to rotatably engage the pod supporting strut and the pod below a buoyant body, wherein said pod and upright pod supporting strut are rotatable about a substantially first vertical axis (C) through the swivel bearing, characterized in that the pod supporting strut (12) is shaped essentially as an upstanding air foil and wherein an axis (T) of the propeller shaft (15), a leading edge (12A) of the strut which faces the propeller (18) and the vertical axis (C) all lie in a vertical chord plane of the strut, wherein, the pod supporting strut (12) is provided at a trailing edge (12B) thereof with a rudder (19) which is angularly movable about a second axis (L) spaced apart from the first vertical axis (C), the second axis (L) also being located in the chord plane (V) of the pod support.

2. A marine propulsion and steering unit according to claim 1, characterised in that the rudder (19) is flush-mounted in the trailing edge portion of the pod supporting strut (12).

3. A marine propulsion and steering unit according to claim 1, characterised in that the rudder (19) is associated with a rudder actuator (20) which is drivingly connected to the rudder and disposed at the upper end of the pod supporting strut (12).

4. A marine propulsion and steering unit according to claim 1, wherein the second axis is set at angle to the first vertical axis.

* * * * *